US006053771A

United States Patent [19]

Hood, III et al.

[11] Patent Number: 6,053,771

[45] Date of Patent: Apr. 25, 2000

[54] ELECTROMAGNETIC SHIELD CONNECTOR

[75] Inventors: Charles D. Hood, III, Cedar Park; Damon W. Broder, Austin, both of Tex.

[73] Assignee: Dell USA L.P., Round Rock, Tex.

[21] Appl. No.: 08/915,091

[22] Filed: Aug. 20, 1997

[51] Int. Cl.[7] ..... H01R 13/648

[52] U.S. Cl. ..... 439/607; 439/947; 174/35 R; 361/818

[58] Field of Search ..... 439/75–79, 81–83, 439/92, 95, 607–609, 947; 174/35 R, 35 C, 51; 361/816–818

[56] References Cited

U.S. PATENT DOCUMENTS

| | | | |
|---|---|---|---|
| 4,428,356 | 1/1984 | Hamsher, Jr. et al. | 29/832 |
| 4,680,676 | 7/1987 | Petratos et al. | 361/424 |
| 5,175,395 | 12/1992 | Moore | 174/35 R |
| 5,262,590 | 11/1993 | Lia | 174/36 |
| 5,311,408 | 5/1994 | Ferchau et al. | 361/818 |
| 5,323,299 | 6/1994 | Weber | 361/818 |
| 5,335,147 | 8/1994 | Weber | 361/818 |
| 5,353,201 | 10/1994 | Maeda | 361/816 |
| 5,519,585 | 5/1996 | Jones et al. | 361/818 |
| 5,562,487 | 10/1996 | Ii et al. | 439/495 |
| 5,707,244 | 1/1998 | Austin | 439/95 |
| 5,742,004 | 4/1998 | Greco et al. | 174/35 R |

OTHER PUBLICATIONS

U.S. Patent application entitled "Combination Electromagnetic Shield and Heat Spreader", filed Aug. 20, 1997, Charles D. Hood, III, and Damon W. Broder, Serial No. 08/915,090 (copy not included).

*Primary Examiner*—Khiem Nguyen
*Attorney, Agent, or Firm*—Skjerven, Morrill, MacPherson, Franklin & Friel, LLP; Stephen A. Terrile; David G. Dolezal

[57] ABSTRACT

A system for electrically coupling an electromagnetic shield to a voltage reference such as a ground plane. The system includes a voltage reference and a multi conductor connector having a plurality of conductors. The conductors of the multiconductor connector are electrically coupled to the voltage reference. The system also includes an electromagnetic shield and an extension, such as a tab, electrically coupled to the electromagnetic shield. The extension has a first portion that is inserted into an opening of the multiconductor connector to electrically contact the conductors of the multiconductor connector to electrically couple the electromagnetic shield to the voltage reference.

46 Claims, 5 Drawing Sheets

ELECTROMAGNETIC SHIELD CONNECTOR

BACKGROUND OF THE INVENTION

1. Cross-Reference to Related Applications

This application relates to co-pending U.S. patent application Ser. No. 08/915,090, attorney docket number M-4932 US, filed on even date herewith, entitled "Combination Electromagnetic Shield and Heat Spreader" and naming Charles D. Hood, III, Damon W. Broder, and Eric B. Holoway as inventors, the application being incorporated herein by reference in its entirety.

2. Field of the Invention

The present invention relates to electromagnetic shielding for computer systems and more specifically to providing a low impedance electrical connection for an electromagnetic shield.

3. Description of the Related Art

An electromagnetic shield is typically a metallic partition placed between two regions of space. The electromagnetic shield controls the propagation of electric and magnetic fields from one of the regions to the other. An electromagnetic shield may be used to contain electromagnetic fields if the shield surrounds the source of the electromagnetic fields.

A solid electromagnetic shield that completely surrounds a product can be at any potential and still provide effective electromagnetic shielding. That is, the shield prevents outside influences from affecting circuits inside the electromagnetic shield and vice versa. Thus, the electromagnetic shield need not to be grounded or have its potential defined in any way. However, an ungrounded or undefined electromagnetic shield should completely enclose the object being protected and that object being protected should have no connection to the outside world.

In practice, however, the electromagnetic shield is not a complete enclosure, and the object inside does have connections to the outside world, either directly, through signal and/or power leads, or indirectly, through stray capacitance due to holes in the electromagnetic shield. In such cases, the electromagnetic shield should be grounded or have its voltage potential defined with respect to the noise source to prevent the noise source's potential from coupling to the enclosed object. An ungrounded or undefined electromagnetic shield's potential varies with conditions and location, and therefore the noise coupled to the object inside also varies.

Grounding also has other benefits. Grounding provides a path for radio frequency (RF) currents to flow on the structure. Grounding also prevents the buildup of AC potentials on the equipment enclosure. Grounding provides a fault-current return path to protect personnel from shock hazards. Grounding also prevents the buildup of static charge.

The electromagnetic shield should have a low-impedance coupling with a voltage reference such as a ground plane of a printed circuit board in at least two places in order to properly define the voltage potential or ground the electromagnetic shield in a computer system. However, today's computer systems include high frequency electromagnetic sources such as processors which may require the electromagnetic shield to be electrically coupled to a voltage reference such as a ground plane at several locations. The higher frequencies of the electromagnetic sources require closer spacings between the grounding connections of the electromagnetic shield to a voltage reference in order to provide effective electromagnetic shielding. Coupling a generally planar electromagnetic shield at several closely spaced locations around its perimeter allows an electromagnetic shield to form the top portion of an effective electromagnetic shield enclosure with a ground plane forming the bottom portion.

Screws, star washers, thread-cutting screws, soldering, grounding clips, or other types of grounding connectors can be used to provide a low impedance coupling. However, these methods can be expensive and increase the complexity of the manufacturing a circuit board, especially as more grounding connections are used for a given computer system.

What is needed is a simple and cost efficient way to provide a low impedance electrical coupling of an electromagnetic shield to a voltage reference such as a ground plane.

SUMMARY OF THE INVENTION

It has been discovered that electrically coupling a electromagnetic shield to a voltage reference via an extension which electrically contacts the conductors of a multiconductor connector electrically coupled to the voltage reference advantageously provides a low impedance and cost effective way to electrically couple the electromagnetic shield to a voltage reference such as a ground plane of a printed circuit board.

More specifically, in one aspect of the invention, a system for electrically coupling an electromagnetic shield to a voltage reference includes a voltage reference and a multi conductor connector having a plurality of conductors. At least two of the plurality of conductors are electrically coupled to the voltage reference. The system also includes an electromagnetic shield and an extension electrically coupled to the electromagnetic shield. The extension has a first portion that is in electrical contact with the at least two of the plurality of conductors. The electromagnetic shield is electrically coupled to the voltage reference via the electrical contact of the extension with the at least two of the plurality of conductors.

In another aspect of the invention, a computer system includes a central processing unit having a grounding connection, a memory electrically coupled to the central processing unit, and a printed circuit board having a voltage reference. The central processing unit is mounted on the printed circuit board. The computer system also includes a multi conductor connector mounted on the printed circuit board. At least two of the plurality of conductors of the multi conductor connector are electrically coupled to the voltage reference. The computer system further includes an electromagnetic shield and an extension electrically coupled to the electromagnetic shield. The extension has a first portion that is in electrical contact with the at least two of the plurality of conductors. The electromagnetic shield is electrically coupled to the voltage reference via the electrical contact of the extension with the at least two of the plurality of conductors.

The multi conductor connectors can advantageously provide a space separation between the printed circuit board and the electromagnetic shield to prevent shorting of integrated circuits (ICs) to the electromagnetic shield.

Another advantage of the present invention is that the multiconductor connector does not require the use of screw holes in the printed circuit board in order to electrically couple the electromagnetic shield to the voltage reference.

Another advantage of the present invention is that standard multiconductor connectors can be used to electrically couple the electromagnetic shield to a voltage reference. This advantageously allows for the manufacturing of printed circuit boards in computer systems with the use of preexisting standardized tools.

Another advantage of the present invention is that the electrical coupling and decoupling of the electromagnetic shield to a voltage reference can be easily made without the use of tools.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DETAILED DESCRIPTION

The following sets forth a detailed description of the best contemplated mode for carrying out the invention. The description is intended to be illustrative of the invention and should not be taken to be limiting.

Figure 1:
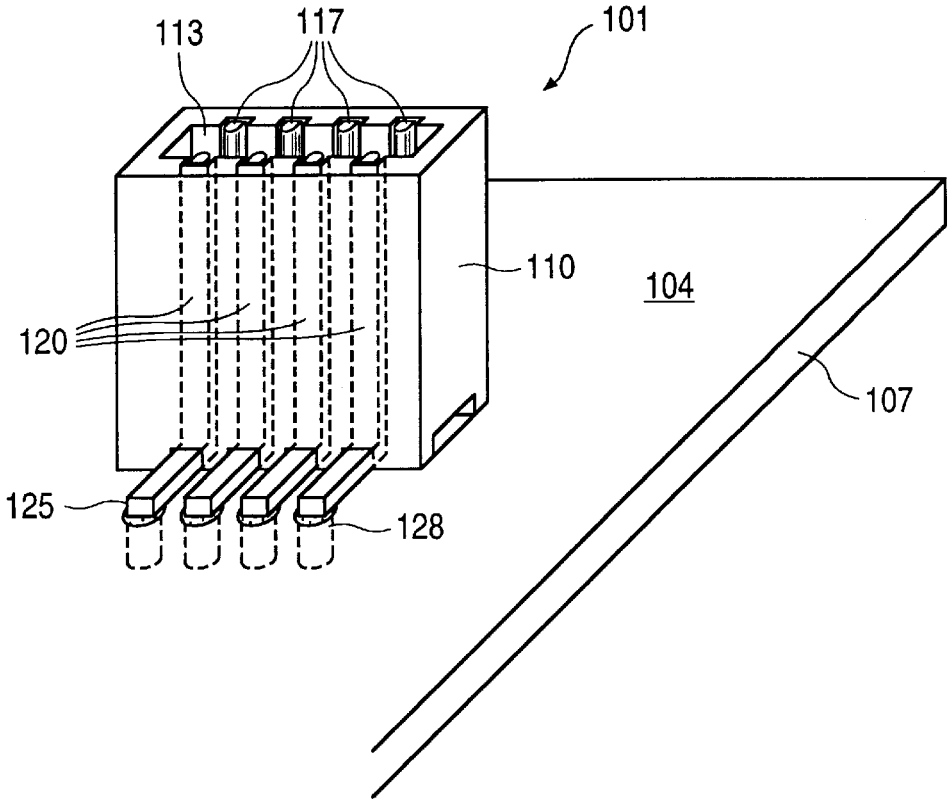
FIG. 1 is a perspective view of one embodiment of a multiconductor connector mounted on a mounting board.

FIG. 1 shows a perspective view of one embodiment of a multiconductor connector mounted on a mounting board. The multiconductor connector 101 includes an enclosure 110. In the embodiment shown, each conductor of the multiconductor connector 101 includes one of a first set of vertical prongs 117 and one of a second set of vertical prongs 120. These vertical prongs 117 and 120 are accessible through an opening 113 on a top side of the enclosure 110, relative to the view shown in FIG. 1. Each of the connector prongs 117 and 120 are electrically coupled to one connector extension 125. In the embodiment of FIG. 1, connector 101 is a four conductor connector with each conductor being electrically coupled to a vertical prong 117 located in the back of the enclosure 110, relative to the view shown in FIG. 1, and to a vertical prong 120 located in the front side of the enclosure 110, relative to the view shown in FIG. 1. The multiconductor connector 101 is mounted to a planar side 104 of a mounting board 107, which in the embodiment shown is a printed circuit board or printed wiring board. In the embodiment shown, printed circuit board 107 is of a flat and rectangular shape and is made out of a plastic laminate with enclosed electrically conductive layers (not shown). The connector extensions 125 are soldered to the planar side 104 of the printed circuit board 107 to mount the multiconductor connector 101 to the printed circuit board 107. The connector may be mounted on the printed circuit board by surface mounting techniques (SMT) or by standard through-hole solder techniques.

In the embodiment shown, the multiconductor connector 101 is mounted on printed circuit board 107 such that the opening 113 of enclosure 120 is generally parallel to the planar surface 104 of the printed circuit board 107.

Figure 2:
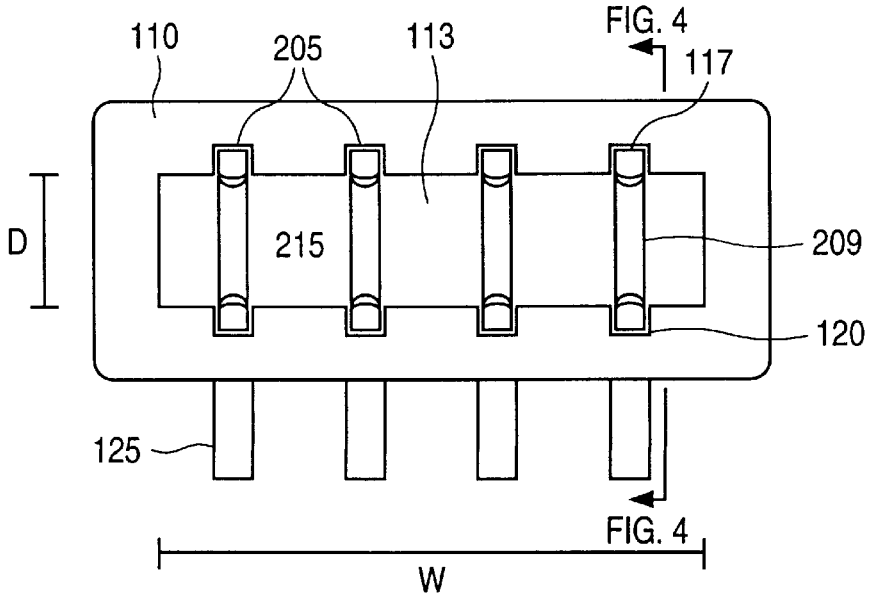
FIG. 2 a top view of one embodiment of a multiconductor connector.

FIG. 2 shows a top view of one embodiment of the multiconductor connector according to the present invention. Each one of the connector prongs 117 and 120 is connected to a transverse prong 209 located on an interior side 215 of enclosure 110. These transverse prongs 209 are accessible through opening 113 in enclosure 110. Each transverse prong 209 is electrically coupled to one of the connector extensions 125 that extends out from the enclosure 110.

In the embodiment shown, multiconductor connector 101 is a non zero insertion force (non ZIF) type connector for a standard flex circuit connector. A non ZIF connector requires an insertion force to plug in a corresponding connector designed to be received by the non ZIF connector. In the embodiment shown, the multiconductor connector 101 is a 4 circuit or 4 conductor model. One type of multiconductor connector that can be used is available under the trade designation 04 FM-1.0 BP from JST Corporation. The opening 113 of connector 101 has a width and a depth as shown by the dimensions in FIG. 2. The width of the opening 113 is substantially greater than the depth. Typically, a compatible multiconductor male connector is inserted into the opening 113 of the multiconductor connector 101 where each conductor of the male connector is electrically connected to a respective conductor of the multiconductor electrical connector 101.

Figure 3:
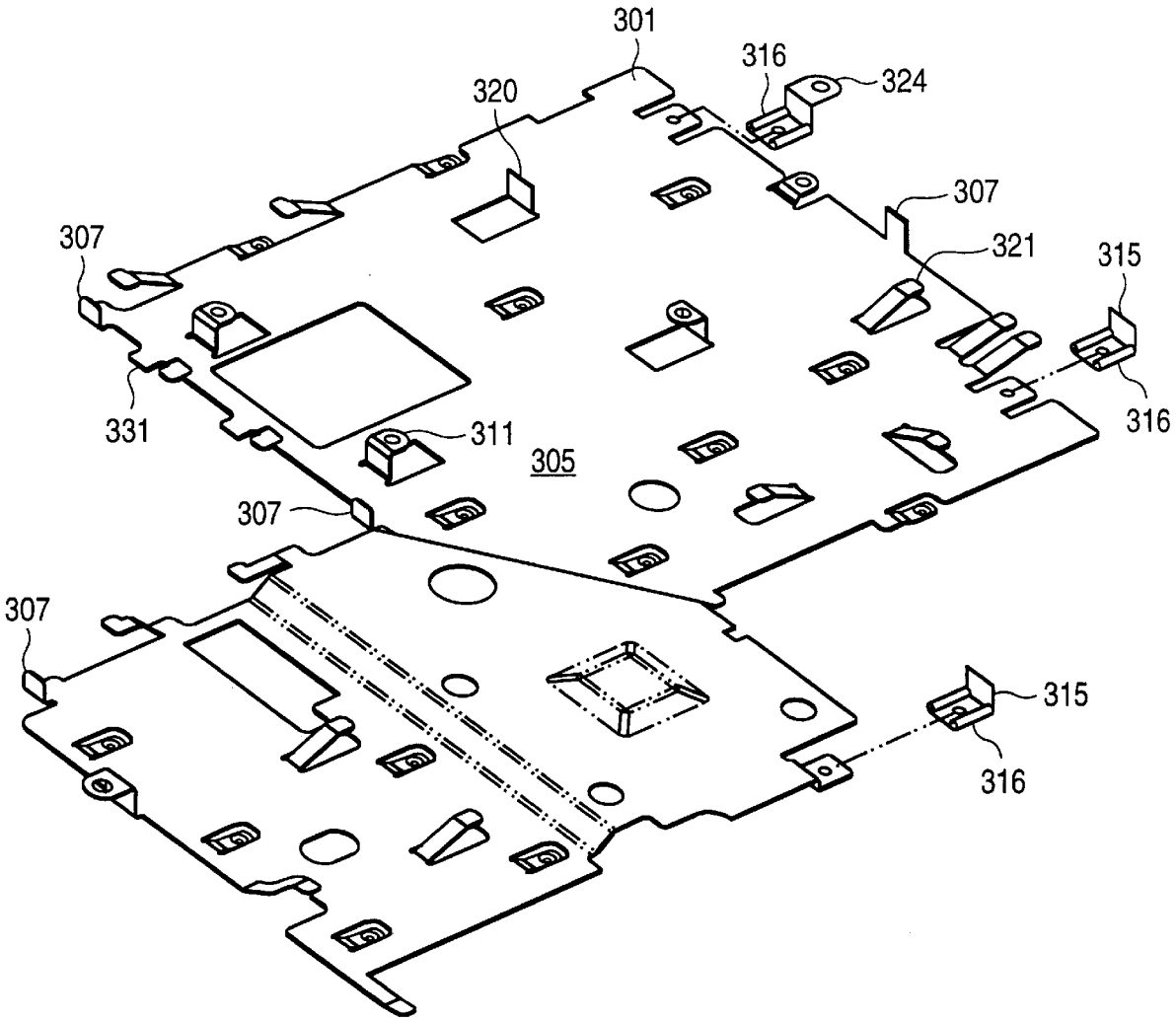
FIG. 3 is a perspective view of one embodiment of an electromagnetic shield.

FIG. 3 shows a perspective view of one embodiment of an electromagnetic shield according to the present invention. In the embodiment shown, shield 301 has a generally planar portion including two generally planar sides with planar side 305 visible in FIG. 3. Integrally connected to the electromagnetic shield 301 are extensions 307 and 320, which in the embodiment shown are tabs. Tabs 307 extend from the edges of electromagnetic shield 301 and tabs 320 extend from the middle portion of electromagnetic shield 301. Also integrally connected to the electromagnetic shield and extending from the electromagnetic shield are spring fingers 321 and screw hole tabs 311. Spring fingers 321 electrically couple the electromagnetic shield 301 to a voltage reference such as a ground plane of a printed circuit board. Screw hole tabs 311 secure the electromagnetic shield to the printed circuit board with screws. FIG. 3 also shows detachable tabs 315 and detachable screw tabs 324. These detachable tabs 315 and screw tabs 324 are electrically connected and physically attached to the electromagnetic shield 301 via a clipping portion 316 that also includes a detent.

In the embodiment shown, electromagnetic shield 301 is constructed from a sheet of metallic material or a metallic coated material that is electrically conductive. One type of material used to make the electrical magnetic shield is beryllium copper. For example, U.S. patent application entitled "Combination Electromagnetic Shield and Heat Spreader", Ser. No. 08/915,090 discloses an electromagnetic shield made of alloys of beryllium copper having certain properties that enable the electromagnetic shield to serve as a heat sink as well. Shield 301 can also be made from other materials such as phosphorous bronze, steel, brass, or aluminum. In other embodiments, the electromagnetic shield may be plated with such metals as tin, gold, or palladium to improve electrical conductivity. In other embodiments, the electromagnetic shield can be made of plated or coated plastics such as a copper polyester laminate.

The electromagnetic shield 301 is constructed of a flat sheet of metal that is initially cut in a first shape. To form tab 307, a flat extension (similar to item 331) extending from the electromagnetic shield 301 is formed when the flat sheet is cut. This flat extension is bent at an approximately 90 degree angle to form tab 307. To form tab 320, a three sided cut is made in the middle of electromagnetic shield 301. The portion of the magnetic shield 301 surrounded by the three sided cut is bent at an approximately 90 degree angle to form tab 320.

In the embodiment shown, the electromagnetic shield is of a generally flat or planar form. However, in other embodiments, the electromagnetic shield may take other forms and shapes. In other embodiments, the electromagnetic shield may have side panels extending in a perpendicular direction from the edge or perimeter of the planar portion of the electromagnetic shield 301.

Figure 4:
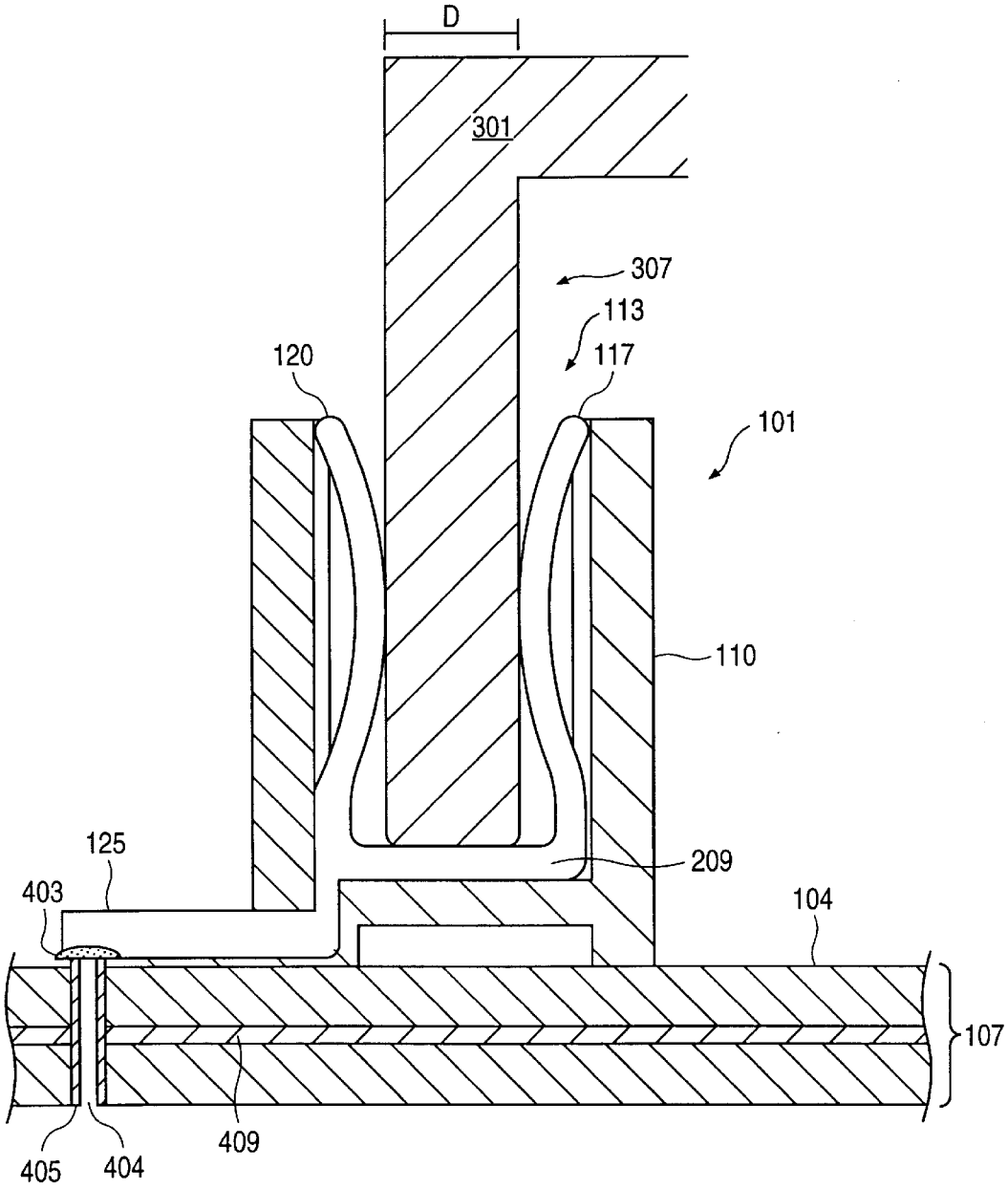
FIG. 4 is a cut away view of one embodiment of an extension of an electromagnetic shield in electrical contact with a conductor of a multiconductor connector to electrically couple the electromagnetic shield to a voltage reference.

FIG. 4 shows a cut away side view of one embodiment of an extension of an electromagnetic shield in electrical contact with a conductor of a multiconductor connector to electrically couple the electromagnetic shield to a voltage reference. Tab 307 extends from electromagnetic shield 301 and is integrally connected to electromagnetic shield 301. In other embodiments, detachable tabs 315, soldered tabs, or other types of extensions can be used to electrically connect the electromagnetic shield to a multiconductor connector. In the embodiment shown, tab 307 is of a shape that allows a portion of the tab 307 to be inserted into the opening 113 of multiconductor connector 101. When inserted into the multiconductor connector 101, tab 307 electrically contacts vertical prongs 120 and 117 and transverse prongs 209 to electrically couple the electromagnetic shield 301 to each conductor of the multiconductor connector 101. The cut away view of FIG. 4 only shows one of the conductors of the multiconductor connector 101. In the embodiment shown, vertical prongs 117 and 120 have an inward curve, relative to the view shown in FIG. 4. This inward curve enables the vertical prongs 117 and 120 to provide a continuous inward force on tab 307, relative to the view shown in FIG. 4. This continuous inward force acts to ensure a low impedance electrical contact between the curved part of the vertical prongs 117 and 120 and the portion of the tab 307 inserted into the opening 113 of the multiconductor connector. This inward force also creates static friction between vertical prongs 117 and 120 and the portion of the tab 307 inserted into the opening 113. This static friction provides a counter force against the removal of the tab 307 from the multiconductor connector 101, or a counter force against the movement of tab 307 upwards, relative to the view shown in FIG. 4.

Each conductor formed by prongs 120, 117, and 209 extends through the enclosure 110 of the multiconductor connector 101 via the connector extensions 125. Solder 403 secures the multiconductor connector 101 to the printed circuit board 107 to mount the multiconductor connector 101 to the printed circuit board 107. Solder 403 also electrically connects the connector extensions 125 to a conductive plating 405 of a via 404, which is a hole in the printed circuit board 107. The conductive plated is electrically connected to a voltage reference 409, which in the embodiment shown is a ground plane 409 embedded in the printed circuit board 107 in an orientation parallel to planar side 104 of the printed circuit board 107. Consequently, the electromagnetic shield 301 is electrically grounded to the ground plane 409 via tab 307 electrically contacting prongs 117, 120 and 209 of the multiconductor connector 101 and via connector extensions 125 being soldered to conductive plating 405 which is electrically connected to ground plane 409. In other embodiments, the conductors of the multiconductor connector may be electrically coupled to the embedded voltage reference plane by other techniques known to those skilled in the art. In other embodiments, the ground plane or voltage reference may partially be located on the planar surface 104 of the printed circuit board 107.

Tab 307 has a width and a depth dimension with the depth dimension being shown on FIG. 4. The width and the depth of tab 307 is slightly less than the width and the depth of the opening 113, respectively. In other embodiments, the extensions may have other shapes and/or forms that allow it to electrically contact the conductors of a multiconductor connector in order to provide a low impedance electrical coupling of the electromagnetic shield to a voltage reference.

Figure 4A:
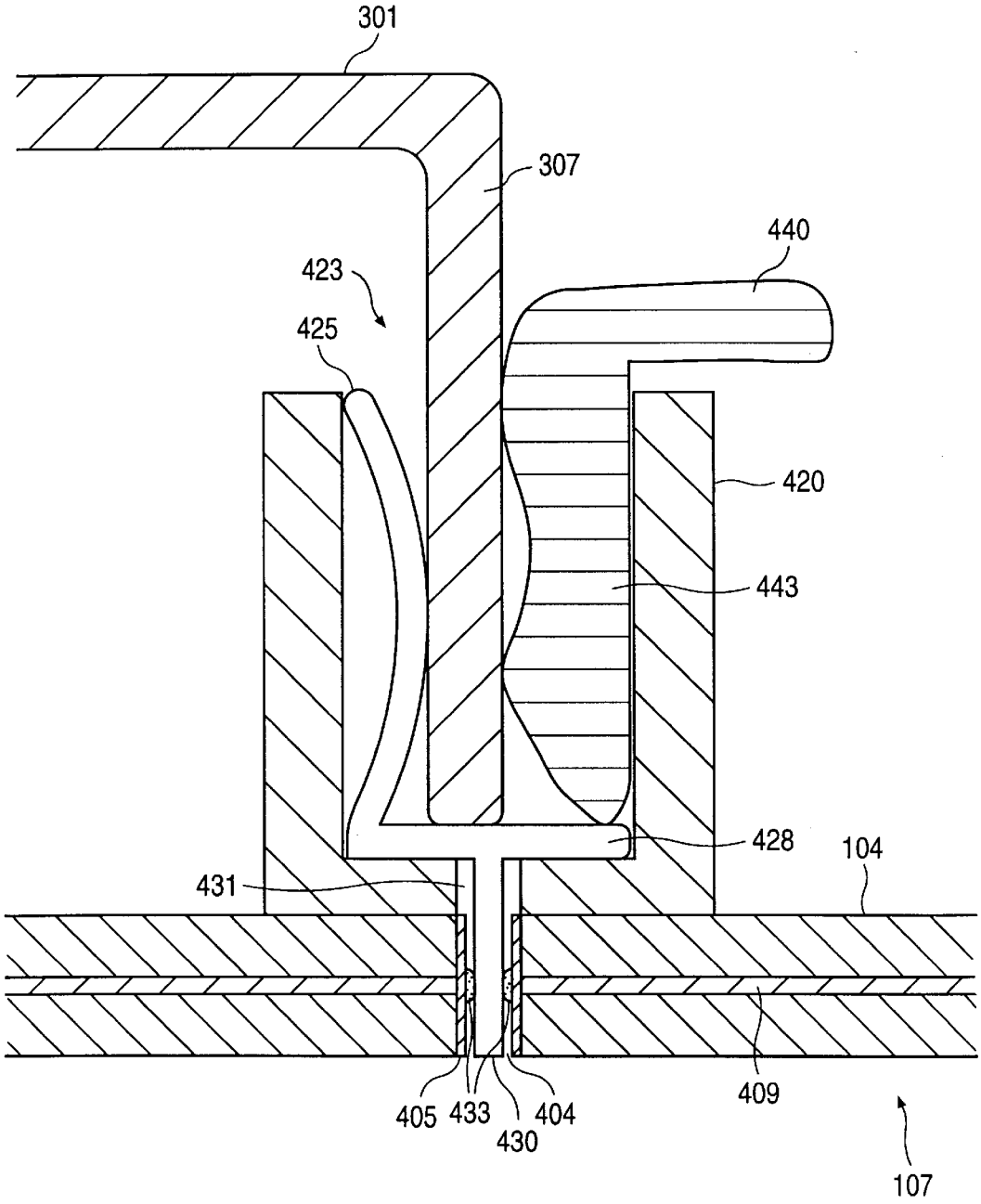
FIG. 4A is a cut away view of one embodiment of an extension of an electromagnetic shield in electrical contact with a conductor of a multiconductor connector to electrically couple the electromagnetic shield to a voltage reference.

FIG. 4A shows a cut away side view of another embodiment of an extension of an electromagnetic shield in electrical contact with a conductor of a multiconductor connector to electrically couple the electromagnetic shield to a voltage reference. The multiconductor electrical connector 420 shown in FIG. 4A is one example of a zero insertion force (ZIF), through hole type connector. Although in other embodiments, other types of through hole connectors and/or ZIF connectors may be used. A ZIF connector requires no force or minimal force, as compared with a non ZIF connector, to plug in a corresponding connector designed to be received by the ZIF connector. In the embodiment shown, wedge structure 440 is slidably attached to multiconductor connector 420 and is made of a plastic or other type of non conductive material. After tab 307 has been inserted into the multiconductor connector through opening 423, wedge structure 440 is slide downward, relative to the view shown in FIG. 4A, to its position shown in FIG. 4A to wedge the portion of the tab 307 inserted into the opening 423 against the vertical prongs 425 of the multiconductor connector 420. This wedge structure 440 provides a force to the left on tab 307 that forces tab 307 against vertical prong 425. This wedging or force to the left helps to ensure a low impedance electrical contact between the tab 307 and the curved portion of vertical prong 425. This wedging or force to the left also creates static friction between the vertical prongs 425 and the portion of the tab 307 inserted into the opening 423 and between wedge structure 440 and the portion of the tab 307 inserted into the opening 423. This static friction provides a counter force against the removal of the tab 307 from the multiconductor 420, or a counter force against the movement of tab 307 upwards, relative to the view shown in FIG. 4A.

The electrical connector 420 is a through hole type multiconductor connector in that the conductors of the multiconductor connector extend through the bottom of the multiconductor connector 420. Connector extensions 430, which are electrically connected to transverse prongs 428, extend through hole 431 of multiconductor connector 420. Connector extensions 430 extend into vias 404 with electrically conductive plating 405 that is electrically connected to ground plane 409. In the embodiment shown, solder 433 electrically connects the connector extension 430 to the electrically conductive plating 405 to couple the electromagnetic shield 301 to the ground plane 409. In other embodiments, the diameter of connector extension 430 is large enough not to require solder 433 in order to make a low impedance electrical contact with the electrically conductive plating 405. In other embodiments, other types of through hole connectors may be used including non ZIF connectors. In other embodiments, other types of ZIF connectors, including non through hole type connectors, may be used as well.

Figure 5:
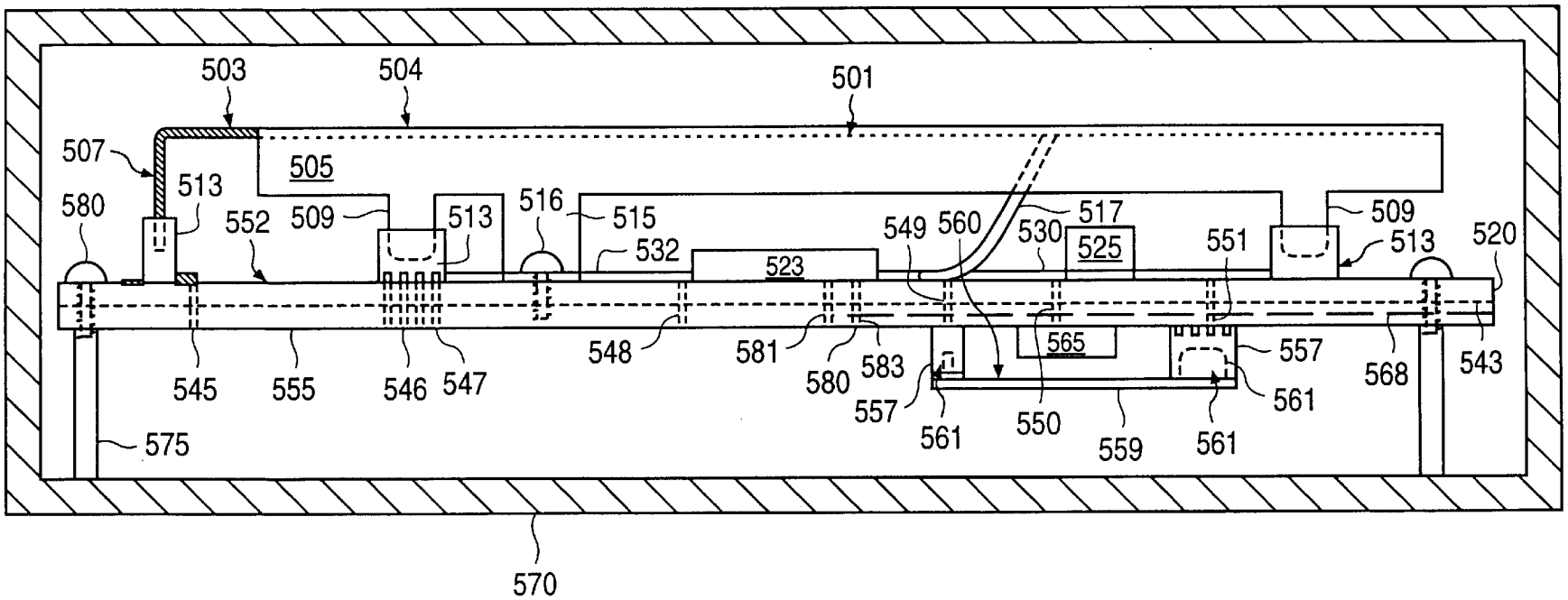
FIG. 5 is a side cut away view of one embodiment of a computer system according to present invention.

FIG. 5 shows a cut away side view of a portion of a computer system that includes an electromagnetic shield coupled to a voltage reference via a multiconductor connector. The electromagnetic shield 501 in FIG. 5 includes a planar portion 503 having two planar sides with planar side 504 facing upwards, relative to the view shown in FIG. 5. The electromagnetic shield 501 also includes a side portion 505 that extends downward, relative to the view shown in FIG. 5, from the edge of the generally planar portion 503. Tabs 509 extend from side portion 505 and tabs 507 extend from the planar portion 503. The electromagnetic shield 501 also includes a screw tab 515 which along with screw 516 is used to secure the electromagnetic shield 501 to the printed circuit board 520. In some embodiments, screw 516 also electrically couples shield 501 to a voltage reference plane 543, shown in phantom, embedded in the printed circuit board 520. In the embodiment shown, voltage reference plane 543 is a ground plane whose voltage potential is the computer system ground. Ground plane 543 is embedded in the printed circuit board 520 in a parallel orientation with the planar side 552 of printed circuit board 520. In the embodiment shown, ground plane 543 is embedded across a substantial majority of the printed circuit board 520.

Multiconductor connectors 513 are mounted to the printed circuit board 520 with either glue and/or solder. FIG. 5 shows tabs 507 and 509 inserted into the openings of the multiconductor connectors 513 where the tabs are in electrical contact with the conductors of the multiconductor connectors 513. The multiconductor connectors 513 are electrically coupled to the embedded ground plane 543 by being soldered to the electrically conductive plating of vias 545–547. The electrically conductive plating of vias 545–547 is electrically connected to the embedded ground plane 543. In other embodiments, the electrical coupling of the multiconductor connector to the embedded voltage reference plane is accomplished by soldering the through hole extension connector of the multiconductor connector to the electrically conductive plating of a via (See FIG. 4A). In other embodiments, the spacing between the multiconductor connectors 513 can be reduced to provide more effective electromagnetic shielding for higher frequency ICs.

The electromagnetic shield 501 provides electromagnetic shielding for the (integrated circuits) ICs 523 and 525 mounted on the printed circuit board 520. In the embodiment shown, integrated circuit 523 is a central processing unit and integrated circuit 525 is a RAM chip. The central processing unit 525 is electrically coupled to the RAM 525 via tracing layers 530 which are located on a planar side 552 of printed circuit board 520. A grounding connection of the central processing unit 523 is electrically connected to tracing layer 532 which is soldered to one or more conductors of the middle multiconductor connector 513, relative to the view shown in FIG. 5. In other embodiments, tracing layer 532 is soldered to the electrically conductive plating of via 548 which is electrically connected to ground plane 543.

A spring finger 517 extends from planar portion 503 of the electromagnetic shield 501 and contacts an electrically conductive surface on the planar side 552 of circuit board 520 which is electrically coupled to the embedded ground plane 543.

Multiconductor connectors 557 are mounted to a second planar side 555 of the printed circuit board 520. Second planar side 555 is parallel to planar side 552. Multiconductor connectors 557 are electrically coupled to a second voltage reference plane 568 which is embedded in the printed circuit board 520 at a location below ground plane 543, relative to the view shown in FIG. 5. In the embodiment shown this second voltage reference plane 568 extends partially across the printed circuit board 520. In the embodiment shown, voltage reference plane 568 is at a voltage potential of +3.3 VDC with respect to the computer system ground. Thus, the electromagnetic shield 559 is also at +3.3 VDC with respect to the computer system ground. One advantage of having shield 559 at a voltage potential other than the computer ground is that shield 559 can also perform the function of a voltage rail.

In other embodiments, the voltage reference plane 568 may be at other voltage potentials with respect to the computer system ground. In other embodiments, voltage reference planes 543 and 568 are both ground planes electrically coupled through the electrically conductive plating of vias 549 and 551. In other embodiments, the conductors of the multiconductor connectors 557 are electrically coupled to both grounding planes 543 and 568 through vias 549 and 551.

In the embodiment shown, filter capacitor 580 is electrically coupled to the ground plane 543 via the electrically conductive plating of via 581. Capacitor 580 also is electrically coupled to +3.3 VDC voltage reference plane 568 via the electrically conductive plating of via 583. Capacitor 583 selectively shorts high frequency noise between the two reference planes 543 and 568.

Mounted to the second planar side 555 of printed circuit board 520 is an integrated circuit 565. Integrated circuit 565 may be electrically coupled to either or both voltage reference planes 543 and 568. A second electromagnetic shield 559 provides electromagnetic shielding for integrated circuit 565. This second electromagnetic shield 559 is electrically coupled to the +3.3 VDC voltage reference plane 568 via the tabs 561 (shown in phantom) inserted into the multiconductor connectors 557. The conductors of the multiconductor connectors 557 are soldered to electrically conductive plating of vias 549 and 551. The electrically conductive plating of vias 549 and 551 is electrically connected to embedded voltage reference plane 568.

The planar side 560 of electromagnetic shield 559 resides against the side of the enclosure of multiconductor connector 557 that has the opening for receiving the tab 561. In this example, the multiconductor connector 557 provides a spatial separation to ensure that the electromagnetic shield 559 maintains a certain distance from the integrated circuit 565 in order to avoid shorting of the components of the integrated circuit 565 to the electromagnetic shield 559.

The printed circuit board 520 along with the integrated circuits 523, 525, and 565, and electromagnetic shields 501 and 559 are all housed within a computer system enclosure 570. Printed circuit board 520 is secured with screws 580 to pillars 575 attached to the enclosure.

An advantage of the present invention is that standard multiconductor connectors can be used to electrically couple the electromagnetic shield to a voltage reference plane. This advantageously allows for the use of existing tools and equipment to mount the standard multiconductor connector to a mounting board in the manufacturing of a computer system. Consequently, specialized tools or equipment is not needed as with specially designed shielding connectors.

In other embodiments, the electromagnetic shield may enclose the printed circuit board 543. In this embodiment, the tabs are attached to a planar side facing the printed circuit board in the middle portion of the electromagnetic shield.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A system for electrically coupling an electromagnetic shield to a voltage reference comprising:

a voltage reference;

a multiconductor connector having a plurality of conductors, at least two of the plurality of conductors electrically coupled to the voltage reference;

an electromagnetic shield; and an extension electrically coupled to the electromagnetic shield, the extension having a first portion, the electromagnetic shield electrically coupled to the voltage reference via the first portion being in electrical contact with the at least two of the plurality of conductors;

wherein the shield is formed from a sheet of metal.

2. The system of claim 1 wherein the plurality of conductors are accessible via an opening of the multiconductor connector;

the first portion is inserted into the opening of the multiconductor connector to make electrical contact with the at least two of the plurality of conductors.

3. The system of claim 2 wherein:

the opening having a width and a depth, the width substantially greater than the depth; and the first portion having a width and a depth, the width and the depth of the first portion are less than the width and the depth, respectively, of the opening.

4. The system of claim 1 further comprising:

the plurality of conductors are accessible via an opening of the multiconductor connector;

the first portion is inserted into the opening of the multiconductor connector;

the wedge structure is positioned within the multiconductor connector to wedge the first portion against the at least two of the plurality of conductors to make electrical contact between the first portion and the at least two of the plurality of conductors.

5. The system of claim 1 wherein the extension is integrally connected to the electromagnetic shield.

6. The system of claim 1 wherein the extension is a tab.

7. The system of claim 1 wherein the multiconductor connector is a flex circuit connector.

8. The system of claim 1 wherein the multiconductor connector is a non zero insertion force (non ZIF) type connector.

9. The system of claim 1 wherein the multiconductor connector is a zero insertion force (ZIF) type connector.

10. The system of claim 1 wherein:

the electromagnetic shield has a generally planar side; and the first portion of the extension is generally perpendicular to the generally planar side.

11. The system of claim 1 wherein:

the sheet of metal is bent at an angle to form the extension.

12. The system of claim 1 wherein the voltage reference has a voltage potential that is at a computer system ground.

13. The system of claim 1 wherein:

the voltage reference is a voltage reference plane.

14. The system of claim 1 further comprising:

a mounting board, the multiconductor connector is mounted on the mounting board.

15. The system of claim 14 wherein:

the mounting board is a printed circuit board.

16. The system of claim 15 wherein the at least two of the plurality of conductors are soldered to at least one trace layer electrically coupled to the voltage reference plane.

17. The system of claim 14 wherein;

the voltage reference is a voltage reference plane is embedded with the mounting board.

18. A system for electrically coupling an electromagnetic shield to a voltage reference comprising:

a voltage reference;

a multiconductor connector having a plurality of conductors, at least two of the plurality of conductors electrically coupled to the voltage reference;

an electromagnetic shield; and an extension electrically coupled to the electromagnetic shield, the extension having a first portion, the electromagnetic shield electrically coupled to the voltage reference via the first portion being in electrical contact with the at least two of the plurality of conductors;

a mounting board, the multiconductor connector is mounted on the mounting board;

a second multiconductor connector mounted on the mounting board, at least two of the plurality of conductors of the second multiconductor connector electrically coupled to the voltage reference; and a second extension electrically coupled to the electromagnetic shield, the second extension having a first portion, the electromagnetic shield electrically coupled to the voltage reference via the first portion of the second extension being in electrical contact with the at least two of the plurality of conductors of the second multiconductor connector.

19. The system of claim 14 further comprising:

a second electromagnetic shield;

a second multiconductor connector mounted on the mounting board, at least two of the plurality of conductors of the second multiconductor connector electrically coupled to the voltage reference; and a second extension extending from the second electromagnetic shield, the, the second electromagnetic shield electrically coupled to the voltage reference via the first portion of the second extension being in electrical contact with the at least two of the plurality of conductors of the second multiconductor connector.

20. The system of claim 19 wherein:

the multiconductor connector mounted on a first planar side of the mounting board, the second multiconductor connector mounted on a second planar side of the mounting board, the first side being an opposite side of the second side.

21. The system of claim 14 further comprising:

a second electromagnetic shield;

a second multiconductor connector mounted on the mounting board, at least two of the plurality of conductors of the second multiconductor connector electrically coupled to a second voltage reference of the mounting board, and a second extension extending from the second electromagnetic shield, the second extension having a first portion, the second electromagnetic shield electrically coupled to the second voltage reference via the first portion of the second extension being in electrical contact with the at least two of the plurality of conductors of the second multiconductor connector.

22. The system of claim 21 wherein:

the voltage reference has a voltage potential that is a computer system ground;

the second voltage reference has a voltage potential that is different than computer system ground.

23. The system of claim 14 wherein:

the voltage reference is a voltage reference plane;

the mounting board includes a via with electrically conductive plating electrically connected to the voltage reference plane; and the at least two of the plurality of conductors are soldered to the electrically conductive plating to electrically couple the at least two of the conductors to the voltage reference plane.

24. The system of claim 14 wherein;

the mounting board includes a via;

one of the at least two of the conductors extends into the via.

25. A system for electrically coupling an electromagnetic shield to a voltage reference comprising:

a voltage reference;

a multiconductor connector having a plurality of conductors, at least two of the plurality of conductors electrically coupled to the voltage reference;

an electromagnetic shield; and an extension electrically coupled to the electromagnetic shield, the extension having a first portion, the electromagnetic shield electrically coupled to the voltage reference via the first portion being in electrical contact with the at least two of the plurality of conductors;

a mounting board, the multiconductor connector is mounted on the mounting board;

wherein the mounting board having a planar side; and wherein the multiconductor connector is mounted to the mounting board in an orientation such that the opening of the multiconductor connector is generally parallel to the planar side of the mounting board.

26. A computer system comprising:

a central processing unit having a grounding connection;

a memory electrically coupled to the central processing unit;

a printed circuit board having a voltage reference, the central processing unit mounted on the printed circuit board;

a multiconductor connector mounted on the printed circuit board, at least two of the plurality of conductors of the multiconductor connector electrically coupled to the voltage reference;

an electromagnetic shield; and an extension electrically coupled to the electromagnetic shield, the extension having a first portion, the electromagnetic shield electrically coupled to the voltage reference via the first portion being in electrical contact with the at least two of the plurality of conductors.

27. The computer system of claim 26 further comprising:

an enclosure housing the printed circuit board and the electromagnetic shield.

28. The computer system of claim 27 wherein:

the electromagnetic shield extending over a first side of the central processing unit, the first side generally parallel to a planar side of the printed circuit board.

29. The computer system of claim 26 wherein the multiconductor connector is a flex circuit connector.

30. The computer system of claim 26 wherein the multiconductor connector is a non zero insertion force type connector, the voltage reference has a voltage potential that is at a DC voltage with respect to the voltage potential of the ground plane.

31. The computer system of claim 26 wherein the voltage reference is a ground plane embedded in the printed circuit board, the grounding connection of the central processing unit electrically coupled to the ground plane.

32. The computer system of claim 26 wherein the grounding connection is electrically coupled to a ground plane having a voltage potential;

the voltage reference has a voltage potential that is at a DC voltage with respect to the voltage potential of the ground plane.

33. The system of claim 26 wherein the plurality of conductors are accessible via an opening of the multiconductor connector;

the first portion is inserted into the opening of the multiconductor connector to make electrical contact with the at least two of the plurality of conductors.

34. The system of claim 1 wherein the all of the plurality of conductors are electrically coupled to the voltage reference.

35. The system of claim 1 wherein at least a majority of the plurality of conductors are electrically coupled to the voltage reference, wherein the first portion is in electrical contact with the at least the majority of the plurality of conductors.

36. A computer system comprising:

a circuit board having a voltage reference;

an integrated circuit located on the circuit board;

a multiconductor connector mounted on the circuit board, at least two of the conductors of the multiconductor connector electrically coupled to the voltage reference;

an electromagnetic shield; and an extension electrically coupled to the electromagnetic shield, the extension having a first portion, the electromagnetic shield electrically coupled to the voltage reference via the first portion being in electrical contact with the at least two of the plurality of conductors;

a second multiconductor connector mounted on the circuit board, at least two of the conductors of the second multiconductor connector electrically coupled to the voltage reference;

a second extension electrically coupled to the electromagnetic shield, the second extension having a first portion, the electromagnetic shield electrically coupled to the voltage reference via the first portion of the second extension being in electrical contact with the at least two of the plurality of conductors of the second multiconductor connector.

37. The computer system of claim 36 wherein:

the electromagnetic shield extends over a first side of the integrated circuit, the first side generally parallel to a planar side of the printed circuit board.

38. The computer system of claim 36 wherein the integrated circuit includes a central processing unit.

39. The computer system of claim 36 wherein the multiconductor connector is a flex circuit connector.

40. The computer system of claim 36 wherein the voltage reference is a ground plane embedded in the circuit board.

41. The computer system of claim 36 wherein:

the plurality of conductors are accessible via an opening of the multiconductor connector;

the first portion is inserted into the opening of the multiconductor connector to make electrical contact with the at least two of the plurality of conductors.

42. The computer system of claim 36 wherein:

the integrated circuit is located on a first planar side of the circuit board; and the multiconductor connector is mounted on the first planar side of the circuit board.

43. The computer system of claim 36 wherein at least a majority of the plurality of conductors are electrically coupled to the voltage reference, wherein the first portion is in electrical contact with the at least the majority of the plurality of conductors.

44. A computer system comprising:

a circuit board having a voltage reference;

an integrated circuit located on the circuit board;

a multiconductor connector mounted on the circuit board, at least two of the conductors of the multiconductor connector electrically coupled to the voltage reference;

an electromagnetic shield; and an extension electrically coupled to the electromagnetic shield, the extension having a first portion, the electromagnetic shield electrically coupled to the voltage reference via the first portion being in electrical contact with the at least two of the plurality of conductors;

wherein the shield is formed from a sheet of metal.

45. The computer system of claim 36 wherein the all of the plurality of conductors are electrically coupled to the voltage reference.

46. The computer system of claim 44 wherein: the sheet of metal is bent at an angle to form the extension.

* * * * *